US007665965B1

(12) United States Patent
Liang

(10) Patent No.: US 7,665,965 B1
(45) Date of Patent: Feb. 23, 2010

(54) TURBINE ROTOR DISK WITH DIRT PARTICLE SEPARATOR

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 437 days.

(21) Appl. No.: 11/654,157

(22) Filed: Jan. 17, 2007

(51) Int. Cl.
*F01D 5/18* (2006.01)

(52) U.S. Cl. ..... 416/1; 416/97 R

(58) Field of Classification Search ..... 415/1, 415/115; 416/1, 90 R, 92, 95, 96 R, 96 A, 416/97 R
See application file for complete search history.

(56) References Cited

U.S. PATENT DOCUMENTS

| | | | | |
|---|---|---|---|---|
| 3,673,771 | A | 7/1972 | Dickey | |
| 3,918,835 | A | 11/1975 | Yamarik et al | |
| 4,309,147 | A | 1/1982 | Koster et al. | |
| 4,522,562 | A * | 6/1985 | Glowacki et al. | 416/95 |
| 4,527,387 | A | 7/1985 | Lastrina et al. | |
| 4,820,122 | A | 4/1989 | Hall et al. | |
| 4,820,123 | A | 4/1989 | Hall | |
| 5,395,212 | A * | 3/1995 | Anzai et al. | 416/97 R |
| 5,603,606 | A * | 2/1997 | Glezer et al. | 416/97 R |
| 5,827,043 | A | 10/1998 | Fukuda et al. | |
| 5,993,156 | A * | 11/1999 | Bailly et al. | 416/96 A |
| 6,413,044 | B1 | 7/2002 | Roeloffs et al. | |
| 6,431,832 | B1 * | 8/2002 | Glezer et al. | 416/97 R |
| 6,464,455 | B2 | 10/2002 | Wilson | |
| 6,969,237 | B2 | 11/2005 | Hudson | |
| 2007/0014664 | A1 * | 1/2007 | Dellmann et al. | 416/97 R |

* cited by examiner

*Primary Examiner*—Christopher Verdier
(74) *Attorney, Agent, or Firm*—John Ryznic

(57) ABSTRACT

A turbine rotor disk with a turbine blade, the rotor disk having a cooling air feed channel to force cooling air into an internal cooling air passage within the turbine blade, the feed channel including a swirl generator at the inlet end to promote a swirling motion within the cooling air, and the feed channel including a helical rib extending from the swirl generator to the outlet of the feed channel to maintain the swirling motion of the cooling air within the feed channel such that dirt particles in the cooling air are collected within the center of the swirling air flow. The feed channel directs the swirling cooling air into a first passage of the internal serpentine flow cooling circuit of the blade. A cooling air exit hole is located at the blade tip and is aligned with the cooling air flow in the first passage. The swirling air flow with the collected dirt particles ejects the dirt particles out through the exit hole while the clean cooling air continues through the serpentine flow circuit to provide cooling for the blade.

12 Claims, 2 Drawing Sheets

TURBINE ROTOR DISK WITH DIRT PARTICLE SEPARATOR

BACKGROUND OF THE INVENTION

1. Field of the Invention

The present invention relates generally to fluid reaction surfaces, and more specifically to turbine rotor disk with a particle separator.

2. Description of the Related Art including information disclosed under 37 CFR 1.97 and 1.98

A prior art cooling air feed channel for a turbine blade is mounted on the side of the rotor disk and located at the entrance point of the live rim. Cooling air channels through the live rim through a cooling air feed channel and periodically bleeds off into the blade cooling cavity for use in cooling the blade. Pressure losses associated with the cooling air in the live rim cavity as well as cross flow losses of bleeding air into the blade cooling cavities lower the useful cooling pressure which translates to lower cooling potential for the use of cooling air to produce higher blade internal cooling performance and provide higher backflow margin for the blade cooling design. In addition, higher cooling supply pressure is needed to overcome these additional losses which induce higher cooling air leakage flow around the blade platform periphery. Other than higher cooling supply pressure requirement for this type of cooling system, the dirt particles within the cooling air will channel into the blade internal cooling passages and in some cases will cause internal plugging of the film cooling holes in the blade. FIG. 1 shows the prior art turbine rotor disk cooling air feed channel 12 arrangement for the current turbine cooling air delivery system. The rotor disk 11 includes a feed channel 12 leading into a live rim cavity 13. The cooling air then flows into one or more cooling passages formed within the blade 14. Exit holes 15 are located along the trailing edge of the blade to discharge cooling air from the internal cooling circuit of the blade. Cover plates 16 are used to enclose the live rim cavity 13. Rotation of the rotor disk forces the cooling air through the feed channel 12 and into the blade internal cooling passages 24.

The cooling air supply pressure loss and plugging issue associated with the above prior art cooling air delivery system can be alleviated by incorporating a new and effective vortex cooling feed channel configuration into the prior art blade cooling air delivery system of the prior art.

It is therefore an object of the present invention to provide for a way to remove dirt particles from the cooling passages within a turbine blade.

BRIEF SUMMARY OF THE INVENTION

A rotor disk of a turbine engine includes a plurality of turbine blades extending radially outward. At least one cooling air feed channel is formed in the rotor disk to channel cooling air into a live rim cavity and then into internal passages within the blade to provide cooling for the blade. The internal cooling circuit of the blade includes a serpentine flow circuit in which the first leg or channel extends from the root toward the blade tip with a cooling air discharge hole at the tip. The serpentine flow passage turns at the tip such that the dirt particles will pass out through the tip hole while the clean air continues around the turn and through the remainder of the serpentine flow circuit to cool the blade. The rotor disk cooling air feed passage includes a swirl generator at the inlet end to induce a swirl flow in the cooling air. The remainder of the feed passage includes helical ribs to keep the cooling air flowing in the swirl formation. The vortex flow of the cooling air within the feed passage forces the dirt particles to stay within the swirl flow center such that the dirt particles are collected in the center of the flow and inline to be discharged out through the hole in the blade tip.

DETAILED DESCRIPTION OF THE INVENTION

The present invention is an improvement over the prior art turbine rotor disk and blade with the cooling air feed channel in the rotor disk that feeds the cooling air into the live rim cavity and then into the cooling air passages formed within the blade. Common elements with the Prior Art FIG. 1 rotor disk are numbered as the same in the present invention of FIG. 2. In the cooling air feed channel 12, a swirl generator 21 is used to impart an initial swirl motion to the cooling air entering and passing through the feed channel 12. The swirl generator 21 in this embodiment is a twisted sheet of metal, such as an inlet guide vane, that is twisted from about 90 degrees to about 180 degrees from the inlet end to the outlet end of the swirl generator. The swirl generator 21 extends across the entire feed channel 12 in the short distance at the inlet. Any length and degree of twist can be used as long as an initial swirl is formed in the cooling air flow. Located within the remaining length of the feed channel 12 is a helical rib or a plurality of helical ribs 22 that extend from the feed channel wall surface and extend into the passage like turbulators in airfoil cooling passages. The helical rib or ribs 22 function to maintain the swirl flow in the cooling air passing through the feed channel 12. The helical rib 22 has a short height such as would turbulators or trip strips extending into the cooling air passage.

Figure 1:
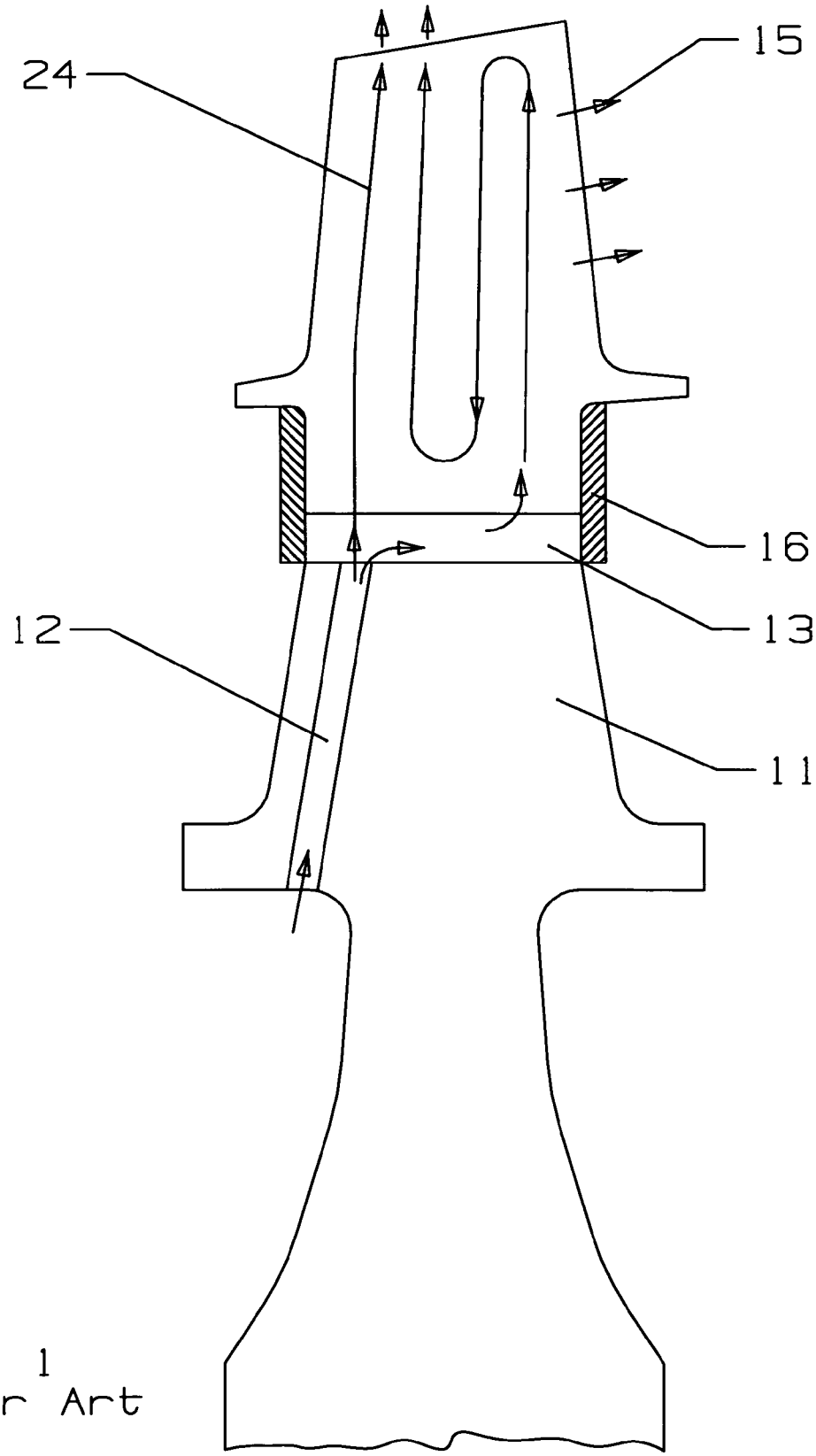
Fig. 1 Prior Art
FIG. 1 shows a prior art turbine rotor disk and blade with a cooling air feed channel.

The feed channel 12 with the swirl generator 21 and helical rib 22 opens into the live rim cavity 13 of the rotor disk and blade as in the prior art FIG. 1 rotor disk. The feed channel 12 opens into the live rim cavity 13 at a position such that the cooling air is directed into the cooling passage in a straight line. The cooling air passage then turns near the blade tip to form a serpentine flow cooling circuit within the blade. A blade tip dirt or particulate purge hole 23 is located at the end of the first cooling passage such that dirt particles 25 will pass directly into the particulate purge hole 23 and be discharged out from the blade while the clean cooling air makes the first turn and follows the serpentine flow cooling circuit to provide cooling for the blade.

Because of a vortex flow formed in the cooling air passing through the feed channel 12 and into the first cooling channel 24 in the blade, the dirt or dust particles 25 will be forced into the center of the swirling flow of cooling air. This will provide for the dirt particles 25 to be aligned with the purge hole 23 at the blade tip. As the cooling air with the vortex flow formed therein passes along the passage 24, the dirt particles 25 will be aligned with the purge hole 23 in the blade tip and be flow out through the particulate purge hole 23—along with some of the cooling air—while the clean air will be forced around the first turn in the serpentine flow cooling circuit and continue through the blade until exiting out the exit holes 15 arranged along the trailing edge of the blade.

Figure 2:
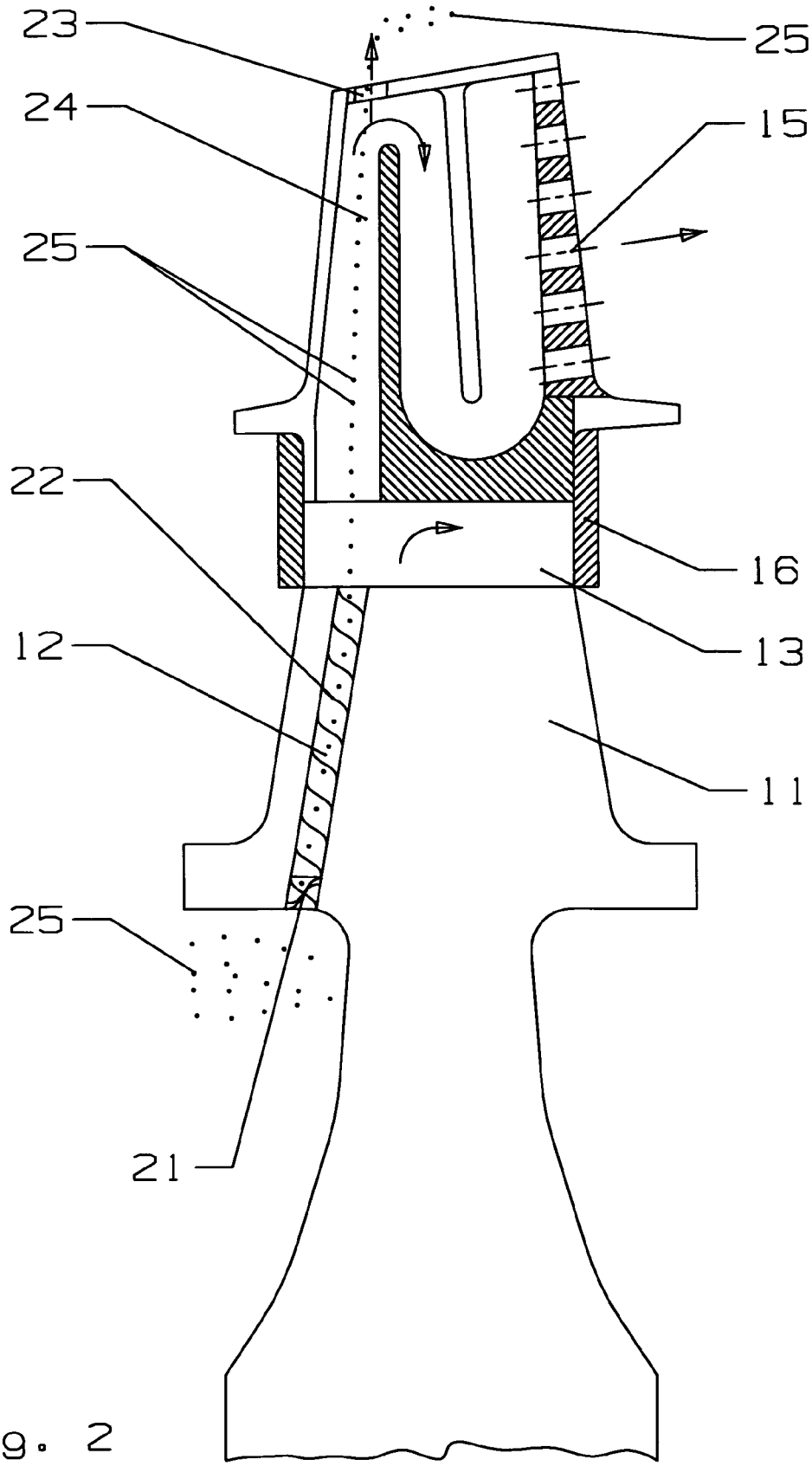
FIG. 2 shows the turbine rotor disk of the present invention with the swirl generator in the cooling air feed channel.

One or more of the feed channels 12 each with a swirl generator 21 and a helical rib 22 can be used in the rotor disk to force cooling air into the live rim cavity 13. Also, the cooling circuit within the blade can be any desirable shape and with one or more separate passages such as a single leading edge channel extending from root to tip with a separate serpentine flow passage ending in a trailing edge channel with exit cooling holes 15. However, the present embodiment as shown in FIG. 2 is preferred in that the cooling air flow with the vortex or twisting flow will allow flow into the first passage 24 in order to concentrate the dirt particles in alignment with the purge hole 23 in the blade tip such that as much of the dirt particles will be discharged out from the cooling air.

The vortex flowing cooling air, which flows outward to the blade cooling supply live rim cavity 13 while swirling in the vortex cooling feed channel, has a higher pressure and a higher velocity at the outer peripheral portion, and is lower in pressure and with a lower velocity at the exit. The higher velocity at the outer periphery of the vortex cooling feed channel generates a higher rate of internal heat transfer coefficient and thus provides for a higher cooling effectiveness for the rotor disk. Helical rib(s) in the radial direction are used on the inner walls of the cooling feed channel to augment the internal heat transfer performance as well as enhance the twisting motion of the cooling air within the feed channel 12.

In addition to the cooling effect within the feed channel 12, the vortex cooling feed channel also functions as a dirt separator. The dirt particles flow toward the center of the vortex axis and subsequently are ejected through the center of the vortex cooling feed channel 12.

An in-line arrangement for the position of the vortex cooling feed channel 12 to the blade leading edge or trailing edge feed channel will provide a directed cooling air delivery into the blade radial flow channel 24 and thus minimize all cooling air pressure loss associated in the live rim cavity 13 and maximize the potential use of the cooling air pressure. In addition, dirt particles 25 within the cooling air will be flowing straight into the blade radial up passage 24 and exit through the dirt purge hole 23 located at the end of the blade radial cooling passage 24. This particular cooling channel alignment enables the removal of dirt particles for an air cooled turbine blade and distributes a major portion of the cooling air into the blade cooling channel first, minimizing the amount of cooling air flowing in the live rim cavity 13. As a result of the vortex flow generator 21 and 22 in the feed channel 12 of the present invention, a lower cooling pressure loss and a dirt free cooling air is formed within the live rim cavity that yields a higher cooling air potential for the use in blade cooling.

The process for separating dirt particles from the cooling air passing through the blade includes the following steps: promoting a vortex swirling motion in the cooling air that is passed into a first channel of the blade cooling passage using a pre-swirler at an entrance to a cooling air feed channel; maintaining the swirling motion of the cooling air in the feed channel using helical ribs that extend most of the remaining length of the feed channel; collecting dirt particles within the swirling cooling air passing through the feed channel; directing the swirling air in the first channel toward a particulate purge hole in the blade tip; and, turning the cooling air through the blade cooling passage at the blade tip such that the dirt particles are ejected out through the particulate purge hole while the clean cooling air continues along the blade cooling air passage to provide cooling for the blade. Additional steps include: providing for an initial swirl to the cooling air flowing into the feed channel; after the step of providing an initial swirl to the cooling air flowing into the feed channel, maintaining the swirl flow in the cooling air for the remainder of the flow along the feed channel; passing the cooling air in the first channel along the leading edge of the blade; and, passing the swirling cooling air from the feed channel into a live rim cavity before passing the swirling cooling air into the first channel.

I claim:

1. A turbine rotor disk with a blade having an internal cooling air passage to provide cooling for the blade, the rotor disk including a cooling air feed channel to force cooling air into the internal cooling air passage due to rotation of the rotor disk, the improvement comprising:

a swirl generator located within the cooling air feed channel, the swirl generator forcing the cooling air to flow through the feed channel in a swirling flow.

2. The turbine rotor disk of claim 1, and further comprising: the swirl generator is located at the entrance to the feed channel.

3. The turbine rotor disk of claim 2, and further comprising: at least one helical rib located in the feed channel and downstream from the swirl generator, the helical rib forcing the swirling air flowing through the feed channel to continue in the swirling flow.

4. The turbine rotor disk of claim 3, and further comprising: the at least one helical rib extends substantially from the swirl generator to the outlet of the feed channel and into a live rim box.

5. The turbine rotor disk of claim 1, and further comprising: the cooling air feed channel is aligned with a first passage in the blade such that the swirling cooling air flows through the first passage in alignment with a blade tip particulate purge hole.

6. The turbine rotor disk of claim 1, and further comprising: the swirl generator and at least one helical rib forces dirt particles to flow along substantially the center of the swirling air flow.

7. The turbine rotor disk of claim 5, and further comprising: the first passage is a first leg of a serpentine flow cooling circuit passing through the blade such that dirt particles trapped within the swirling flow pass out through the particulate purge hole while clean cooling air continues around and through the serpentine flow circuit to cool the blade.

8. The turbine rotor disk of claim 1, and further comprising:

a live rim cavity formed in a blade root;

the feed channel opens into the live rim cavity;

a first channel of a serpentine flow cooling circuit extends along a leading edge of the blade and in alignment with the feed channel such that swirling cooling air continues flowing into the first channel; and, a blade tip purge hole located at the end of the first channel and in alignment with the swirling cooling air such that dirt particles trapped within the swirling flow of cooling air will be discharged out through the purge hole while the clean cooling air continues through the serpentine flow cooling circuit.

9. In a turbine rotor disk having a feed channel in the rotor disk and an internal cooling passage in a rotor blade, a process for separating dirt particles from cooling air passing through the blade comprising the steps of:

promoting a vortex swirling motion in the cooling air that is passed into a first channel of the blade cooling passage;

providing an initial swirl to the cooling air flowing into the feed channel;

collecting dirt particles within the swirling cooling air passing through the feed channel;

directing the swirling air in the first channel toward a particulate purge hole in the blade tip; and, turning the cooling air through the blade cooling passage at the blade tip such that the dirt particles are ejected out through the particulate purge hole while clean cooling air continues along the blade cooling air passage to provide cooling for the blade.

10. The process for separating dirt particles from the cooling air passing through the blade of claim 9, and further comprising the step of:

after the step of providing an initial swirl to the cooling air flowing into the feed channel, maintaining the swirl flow in the cooling air for the remainder of the flow along the feed channel.

11. The process for separating dirt particles from the cooling air passing through the blade of claim 9, and further comprising the step of:

passing the cooling air in the first channel along a leading edge of the blade.

12. The process for separating dirt particles from the cooling air passing through the blade of claim 9, and further comprising the step of:

passing the swirling cooling air from the feed channel into a live rim cavity before passing the swirling cooling air into the first channel.

* * * * *